US010583905B2

(12) United States Patent
Cole et al.

(10) Patent No.: US 10,583,905 B2
(45) Date of Patent: Mar. 10, 2020

(54) SUBMERSIBLE DRONE HAVING ACTIVE BALLAST SYSTEM

(71) Applicant: ABB Schweiz AG, Baden (CH)

(72) Inventors: Gregory Cole, West Hartford, CT (US); William Eakins, Bloomfield, CT (US); Daniel Lasko, Bloomfield, CT (US); Harshang Shah, Bloomfield, CT (US); Thomas Fuhlbrigge, Ellington, CT (US); Biao Zhang, West Hartford, CT (US); Sanguen Choi, Sinsbury, CT (US); Luiz Cheim, St. Charles, MO (US); Poorvi Patel, Ballwin, MO (US); Andrew Salm, West Hartford, CT (US)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 15/834,396

(22) Filed: Dec. 7, 2017

(65) Prior Publication Data

US 2018/0154995 A1 Jun. 7, 2018

Related U.S. Application Data

(60) Provisional application No. 62/431,328, filed on Dec. 7, 2016.

(51) Int. Cl.

| | |
|---|---|
| ***B63G 8/14*** | (2006.01) |
| ***B63G 8/22*** | (2006.01) |
| ***B63G 8/00*** | (2006.01) |

(52) U.S. Cl.

CPC ..... *B63G 8/22* (2013.01); *B63G 8/001* (2013.01); *B63G 2008/005* (2013.01)

(58) Field of Classification Search

CPC ... B63G 8/00; B63G 8/14; B63G 8/22; B63G 8/001; B63G 2008/00; B63G 2008/001;

(Continued)

(56) References Cited

U.S. PATENT DOCUMENTS 3,085,533 A * 4/1963 Goryl ..... B63B 25/08 114/244
3,157,145 A * 11/1964 Farris ..... B63G 8/08 114/332

(Continued)

FOREIGN PATENT DOCUMENTS

WO 2014/120568 A1 8/2014

*Primary Examiner* — Daniel V Venne
(74) *Attorney, Agent, or Firm* — Taft Stettinius & Hollister LLP

(57) ABSTRACT

A submersible inspection drone used for inspection can include a ballast system used to control depth of the submersible inspection drone. The submersible can be configured to communicate to a base station using a wireless transmitter and receiver. The ballast system can include a pressure vessel for storing fluid and a bag for inflating and deflating as it receives a fluid. Buoyancy of the submersible inspection drone can be provided by change in density of the pressure vessel as a compressible gas is expanded when the ballast bag is caused to inflate or deflate. A pump can be used to draw fluid from the ballast bag and store the fluid in the pressure vessel. In one form the pressure vessel can include a compressible fluid and an incompressible fluid, where the incompressible fluid is used to inflate and deflate the bag.

17 Claims, 8 Drawing Sheets

(58) Field of Classification Search
CPC ..... B63G 2008/002; B63G 2008/004; B63G 2008/005
USPC ..... 114/312, 313, 330, 331, 333, 342
See application file for complete search history.

(56) References Cited

U.S. PATENT DOCUMENTS

| | | | | |
|---|---|---|---|---|
| 4,821,665 | A | 4/1989 | Matthias et al. | |
| 5,350,033 | A | 9/1994 | Kraft | |
| 6,104,970 | A | 8/2000 | Schmidt, Jr. et al. | |
| 6,131,531 | A | 10/2000 | McCanna et al. | |
| 7,290,496 | B2 | 11/2007 | Asfar et al. | |
| 7,496,226 | B2 | 2/2009 | Negandaripour et al. | |
| 7,841,289 | B1 * | 11/2010 | Schanz ..... | B63B 25/08 114/256 |
| 8,024,066 | B2 | 9/2011 | Reverte et al. | |
| 8,386,112 | B2 | 2/2013 | Rooney, III et al. | |
| 8,805,579 | B2 | 8/2014 | Skrinde | |
| 9,021,900 | B2 | 5/2015 | Yang et al. | |
| 9,061,736 | B2 | 6/2015 | Smith | |
| 9,064,608 | B2 | 6/2015 | Olsen et al. | |
| 9,156,105 | B1 | 10/2015 | Vallapuzha et al. | |
| 9,183,527 | B1 | 11/2015 | Close et al. | |
| 9,371,960 | B2 | 6/2016 | Lorimer et al. | |
| 2005/0109259 | A1 * | 5/2005 | August ..... | B63G 8/001 114/312 |
| 2010/0180672 | A1 | 7/2010 | Zollinger | |
| 2012/0257704 | A1 | 10/2012 | Asada et al. | |
| 2015/0128842 | A1 * | 5/2015 | Webb ..... | G01C 13/00 114/331 |
| 2015/0233515 | A1 | 8/2015 | Kwon et al. | |
| 2015/0328773 | A1 | 11/2015 | Boca et al. | |
| 2015/0369851 | A1 | 12/2015 | Even et al. | |
| 2016/0068243 | A1 * | 3/2016 | Cheatham ..... | B63G 8/001 114/321 |
| 2016/0129979 | A1 * | 5/2016 | Rossano ..... | B63G 8/001 114/333 |
| 2016/0176485 | A1 * | 6/2016 | Sylvia ..... | B63G 8/001 114/330 |

* cited by examiner

SUBMERSIBLE DRONE HAVING ACTIVE BALLAST SYSTEM

TECHNICAL FIELD

The present invention generally relates to submersible drones having ballast systems, and more particularly, but not exclusively, to evaluating an internal cavity of the submersible drone with the ballast system.

BACKGROUND

Providing ballast systems having a variety of capabilities remains an area of interest. Some existing systems have various shortcomings relative to certain applications. Accordingly, there remains a need for further contributions in this area of technology.

SUMMARY

One embodiment of the present invention is a unique submersible for inspection of an electrical transformer. Other embodiments include apparatuses, systems, devices, hardware, methods, and combinations for controlling depth of submersibles. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
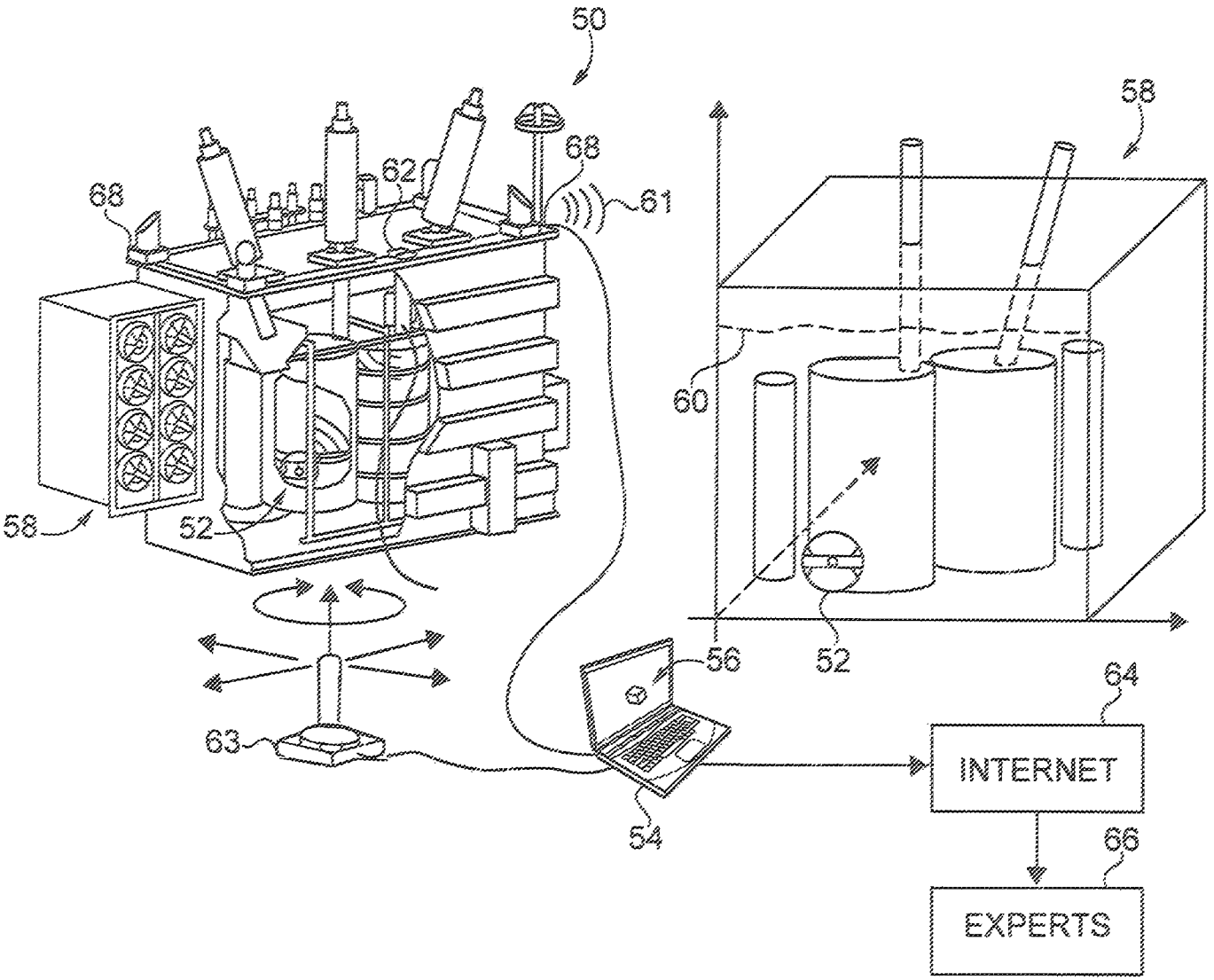
FIG. 1 depicts an embodiment of a submersible drone communicating with a base station.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, there is illustrated a system for in-situ inspection designated generally as 50. The system 50 generally includes an inspection device in the form of a submersible remotely operated vehicle (ROV) 52 which is wirelessly controlled from a control station which, in the illustrated embodiment, includes a computer 54 and a display 56. As used herein, the term "submersible" includes, but is not limited to, a vehicle capable of operation under the surface of a liquid body. Although much of the description that follows utilizes the term ROV for sake of brevity, it will be understood that the various embodiments described herein are not strictly limited to remotely operated vehicles, but can also be utilized with autonomous submersibles as well such as but not limited to those that are remotely triggered but are otherwise autonomous. For example, the inspection devices described herein can be static devices that observe and collect data whether remotely operated or in an autonomous configuration. Such a static device can be placed in its location as a result of operation of the ROV or autonomous device. Thus, embodiments of the device 52 are intended to cover a broad range of devices not simply limited to ROVs unless otherwise indicated to the contrary (as one non-limiting example, use of the term 'drone' is capable of covering ROV as well as autonomous devices 52 or static inspection drones useful for monitoring and/or inspection duties).

Of note in FIG. 1, the system 50 includes components generally on the left and bottom side of the figure, with the components on the upper right representing a schematic model of certain aspects of the system 50 (e.g. the tank in which the ROV 52 is operating) which will be understood by those of skill in the art. In many forms the submersible vehicles described herein are capable of operating in a container which maintains a fluid such as a pool or chemical storage tank, but in other forms can be a sealed container such as a tank. The liquid can take any variety of forms including water, but other liquid possibilities are also contemplated. By way of example, and not limitation, evaluating may be performed on/in portions of ship hulls, electrical interrupters, high voltage switch gears, nuclear reactors, fuel tanks, food processing equipment, floating roof storage system, chemical storage tank, or other apparatuses of similar nature.

The submersible ROV 52 shown in the illustrated embodiment is being used to inspect a tank for a transformer 58, but other applications are contemplated herein. Skilled artisans will appreciate that the inspection typically, but not exclusively, occurs only when the transformer 58 is offline or not in use. In many embodiments the transformer 58 utilizes its liquid as a cooling fluid 60 to maintain and disburse heat generated by the internal components during operation of the transformer. The cooling fluid 60 can be any liquid coolant contained within an electrical transformer, such as but not limited to a liquid organic polymer. Such liquid can therefore be transformer oil, such as but not limited to mineral oil. In other forms the transformer liquid can be pentaerythritol tetra fatty acid natural and synthetic esters. Silicone or fluorocarbon-based oils can also be used. In still other forms a vegetable-based formulation, such as but not limited to using coconut oil, may also be used. It may even be possible to use a nanofluid for the body of fluid in which the robotic vehicle is operating. In some embodiments, the fluid used in the transformer includes dielectric properties. Mixtures using any combination of the above liquids, or possibly other liquids such as polychlorinated biphenyls may also be possible.

As skilled artisans will appreciate, the transformer 58 is typically maintained in a sealed configuration so as to prevent contaminants or other matter from entering. As used herein, a "sealed configuration" of the tank allows for sealed conduits and/or ducts to be associated with the transformer's tank or housing to allow for connection to the electrical components and/or monitoring devices maintained in the tank. The tank is also provided with at least one opening to allow for the filling and/or draining of the cooling fluid. As shown in FIG. 1, a hole 62 can be an existing service hole, e.g. those used for filling the transformer oil and/or those used to enter a tank upon servicing by a technician. In general operation, the oil is inserted through any number of holes located in the top of the tank. Holes 62 may also be provided at the bottom of the tank to allow for the fluid to be drained. The holes 62 are provided with the appropriate plugs or caps. In some embodiments the hole 62 can be sized and structured such that the transformer tank top need not be unsealed completely or at all to introduce the submersible ROV 52. Accordingly, it will be appreciated that the size of the inspection device can be such that it can fit within a designated hole, whether the hole is the hole 62 depicted in the illustration or other types of access points discussed elsewhere herein and/or appreciated by those of skill in the art.

The ROV 52 is insertable into the transformer 58 or sealed container and is contemplated for purposes of the various embodiments herein as being movable utilizing un-tethered, wireless remote control. In the illustrated embodiment the computer 54 (depicted as a laptop computer in the illustrated embodiment although other appropriate computing devices are also contemplated) is contemplated to be in wireless communication with the ROV 52. A motion control input device, such as a joystick 63 is connected to the computer 54 and allows for a technician to control movement of the device 52 inside the transformer 58. Such control can be by visual awareness of the technician and/or by information made available via the display 56 (such as, but not limited to, a virtual model of the transformer 58). Other types of motion control input devices, such as used in video games, handheld computer tablets, computer touch screens or the like may be employed.

In some embodiments the computer 54 can be connected to another computer via a network, such as the depicted internet 64 as one example, so as to allow for the images or sensor data to be transferred to experts, who may be remotely located, designated by the block 66 so that their input can be provided to the technician so as to determine the nature and extent of the condition within the transformer and then provide corrective action as needed. In some embodiments, control of the ROV can also be transferred to an expert, who may be remotely located. In such embodiments, the expert would have another computer that can send control signals via a network to the local computer 54 that in turn sends signals to control the device 52 as described above.

The transformer 58 may be configured with a plurality of signal transmitters and/or receivers 68 mounted on the upper corners, edges or other areas of the transformer 58, or in nearby proximity to the transformer. The transmitters and/or receivers 68 are structured to send and/or receive a wireless signal 61 from the inspection device to determine the position of the inspection device in the transformer tank.

The transmitters and/or receivers 68 can be a transceiver in one embodiment, but can include a transmitter and antenna that are separate and distinct from one another in other embodiments. For example, the transmitter can be structured to send information using different frequencies/modulation/protocols/etc than an antenna is structured to receive. Thus as used herein, the term "transmitter" and "antenna" can refer to constituent parts of a transceiver, as well as standalone components separate and apart from one another. No limitation is hereby intended unless explicitly understood to the contrary that the term "transmitter" and/or "antenna" are limited to stand alone components unless otherwise indicated to the contrary. Furthermore, no limitation is hereby intended that the use of the phrase "transmitters and/or receivers" must be limited to separate components unless otherwise indicated to the contrary.

Informational data gathered by the ROV 52, and any associated sensor, can be transmitted to the computer 54 through the fluid and the tank wall with the openings 62. Use of different communication paths for difference aspects of the operation of the ROV 52 may be used to prevent interference between the signals. Some embodiments may utilize the same communication path to transfer data related to positioning, data information, and control information as appropriate.

Figure 2:
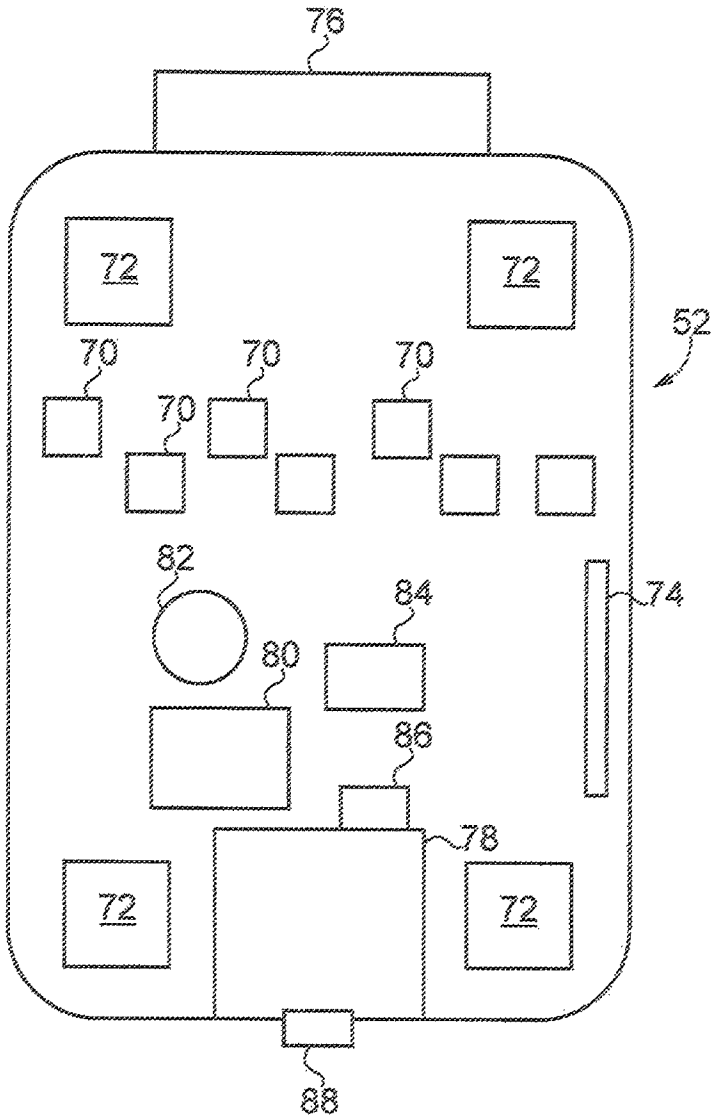
FIG. 2 depicts one embodiment of the submersible drone.

Turning now to FIG. 2, one embodiment of the ROV 52 is depicted as including cameras 70, motors 72 and transmitter and/or receiver 74. Other components may also be included in the ROV but are not illustrated for sake of brevity (e.g. a battery to provide power to the cameras, additional sensors such as rate gyros or magnetometers, etc). The cameras 70 are utilized to take visible and other wavelength images of the internal components of the transformer. In one embodiment of the ROV 52 a number of cameras are fixed in orientation and do not have separate mechanisms (e.g. a servo) two change their point of view. In other embodiments all cameras the ROV 52 have a fixed field of view and not otherwise capable of being moved. These images allow for technicians to monitor and inspect various components within the transformer. The cameras 70 can take on any variety of forms including still picture and moving picture cameras (e.g. video camera). Any number and distribution of the cameras 70 are contemplated. In one form ROV 52 can have an array of cameras 70 distributed in one region, but in other forms the cameras 70 can be located on all sides of the ROV 52. In some embodiments, the ROV 52 is provided with lights which facilitate illumination of the area surrounding the inspection device 52. In some embodiments the lights are light emitting diodes, but it will be appreciated that other illumination devices could be used. The illumination devices are oriented so as to illuminate the viewing area of one or more of the cameras 70. In some embodiments, the user can control the intensity and wavelength of the light.

The motors 72 are used to provide power to a propulsor (e.g. an impeller) which are used to control and/or provide propulsive power to the ROV 52. Each motor 72 can be reversible so as to control the flow of fluid or oil through the flow channels. Each motor can be operated independently of one another so as to control operation of an associated propulsor (e.g. a thruster pump) such that rotation of the pump in one direction causes the liquid to flow through the flow channel in a specified direction and thus assist in propelling ROV 52 in a desired direction. Other configurations of the propulsor are also contemplated beyond the form of a propeller mentioned above, such as a paddle-type pump which could alternatively and/or additionally be utilized. In some embodiments, a single motor may be used to generate a flow of fluid through more than one channel. In other words, a housing of the ROV 52 could provide just one inlet and two or more outlets. Valves maintained within the housing could be used to control and re-direct the internal flow of the fluid and, as a result, control movement of the ROV 52 within the tank. Fluid flow from the motor can also be diverted such as through use of a rudder, or other fluid directing device, to provide the steerage necessary to manipulate the vehicle. By coordinating operation of the motors with a controller, and thus the oil flowing through the housing of the ROV, the inspection device can traverse all areas of the transformer through which it can fit. Moreover, the ROV 52 is able to maintain an orientational stability while maneuvering in the tank. In other words, the ROV 52 can be stable such that it will not move end-over-end while moving within the transformer tank.

The transmitter and/or receiver 74 can be connected to a controller on board the ROV 52 for the purpose of transmitting data collected from the cameras 70 and also for sending and receiving control signals for controlling the motion and/or direction of the ROV 52 within the transformer. The transmitter and/or receiver 74 is structured to generate a wireless signal that can be detected by the computer or any intermediate device, such as through reception via the transmitter and/or receiver 68.

Other aspects of an exemplary remotely operated submersible which is operated in a fluid filled transformer tank described in FIG. 1 or 2 are described in international application publication WO 2014/120568, the contents of which are incorporated herein by reference.

Referring now to FIGS. 1 and 2, transmissions from either or both of the transmitters and/or receivers 68 and 74 can occur over a variety of manners, including various frequencies, powers, and protocols. In some applications the communication between the ROV 52 and the base station can be supplemented with a repeater or relay station, but not all embodiments need include such devices. The manners of transmission between 68 and 74 need not be identical in all embodiments. To set forth just a few examples, the transmitter and/or receiver 68 used for broadcast of signals from the base station can transmit in power that ranges from 1 W to 5 W. The base station can also transmit in frequencies that range from about 300 MHz to about 5 GHz, and in some forms are at any of 300 MHz, 400 MHz, 433 MHz, 2.4 GHz, and 5 GHz. Transmission can occur using any variety of protocols/formats/modulation/etc. In one example, transmission from the base station can use digital radio communications such as that used for RC model cars/boats/airplanes/helicopters. The transmission can also occur as TCP/IP or UDP, it can occur over WiFi radios, serial communication over Bluetooth radios, etc. In one particular form, video transmissions can occur as streaming for a Wi-Fi camera over 2.4 GHz.

In much the same manner as the transmitter and/or receiver 68 of the base station, the transmitter and/or receiver of the ROV 52 can transmit in power that ranges from 250 mW to 3 W. The base station can also transmit in frequencies that range from about 300 MHz to about 5 GHz, and in some forms are at any of 300 MHz, 400 MHz, 433 MHz, 2.4 GHz, and 5 GHz. Transmission can occur using any variety of protocols/formats/modulation/etc. In one example, transmission from the base station can use digital radio communications such as that used for RC model cars/boats/airplanes/helicopters. The transmission could be video over IP, and one embodiment of IP could be WiFi/WLAN. In one non-limiting embodiment the transmission can therefore occur as TCP/IP or UDP, it can occur over WiFi radios, serial communication over Bluetooth radios, etc. In one particular form, video transmissions can occur as streaming for a Wi-Fi camera over 4.2 GHz. IN short, a variety of transmission techniques/approaches/protocols/frequencies/etc are contemplated herein.

The ROV 52 also includes a ballast system capable of inflating and deflating a flexible ballast bag 76. The ballast system is also capable of removing air from an open interior 78 of the ROV 52 in some embodiments and storing the removed air in a pressure vessel 80, which may also be referred to herein as a pressure vessel reservoir, a pressure tank or a fluid reservoir. The ballast system can include the flexible ballast bag 76, the pressure vessel 80, a pump 82, valve 84, and check valve 86. In some embodiments the open interior 78 can be considered part of the ballast system, but other embodiments may consider the open interior 78 to be apart from but nevertheless fluidically connected with the ballast system in the manner discussed above and further below.

The open interior can have a cover 88 that permits access to the open interior 78. The open interior 78 can be used for any variety of purposes and can take on any variety of forms. In some embodiments the open interior is a larger space which is connected to the opening through an open interior conduit. Thus, no limitation is hereby intended by virtue of the shape depicted in the embodiment shown in FIG. 2. In some embodiments the open interior provides a space for components of the ROV 52 such as, but not limited to batteries, controllers, sensors, electronics, etc. In some embodiments the cover 88 may be considered to be integral with the housing of the ROV 52. For example, the housing/hull of the ROV 52 may be capable of being split in two, with either a top half or bottom half considered the 'cover' 88 which permits access to the open interior 78. The cover member 88 an be fastened to enclose the interior of the ROV 52 by any variety of mechanisms, including mechanical (e.g. screw threaded cover, bolted connection, riveted, etc), metallurgical (e.g. brazing or welding, etc), or chemical (e.g. bonding, etc), to set forth just a few nonlimiting embodiments.

Turning now to FIGS. 3-6, various embodiments and operational modes of the ROV 52 ballast system is described, in which the interconnection of various components are also described. FIGS. 3-5B depict different modes of operation of the ballast system, and of note is the power configuration of each of the pump 82 and valve 84. When the pump 82 is energized, it is structured to draw air in through an inlet that can be connected to the ballast bag 76 and the check valve 86. The valve 84 is configured such that it is in a closed state which discourages fluid to flow from the pressure vessel 80 when power is applied to the valve 84; the valve is configured to be in an open state which permits fluid to flow from the pressure vessel 80 to the ballast bag 76 when power is removed from the valve 84.

Figure 3:
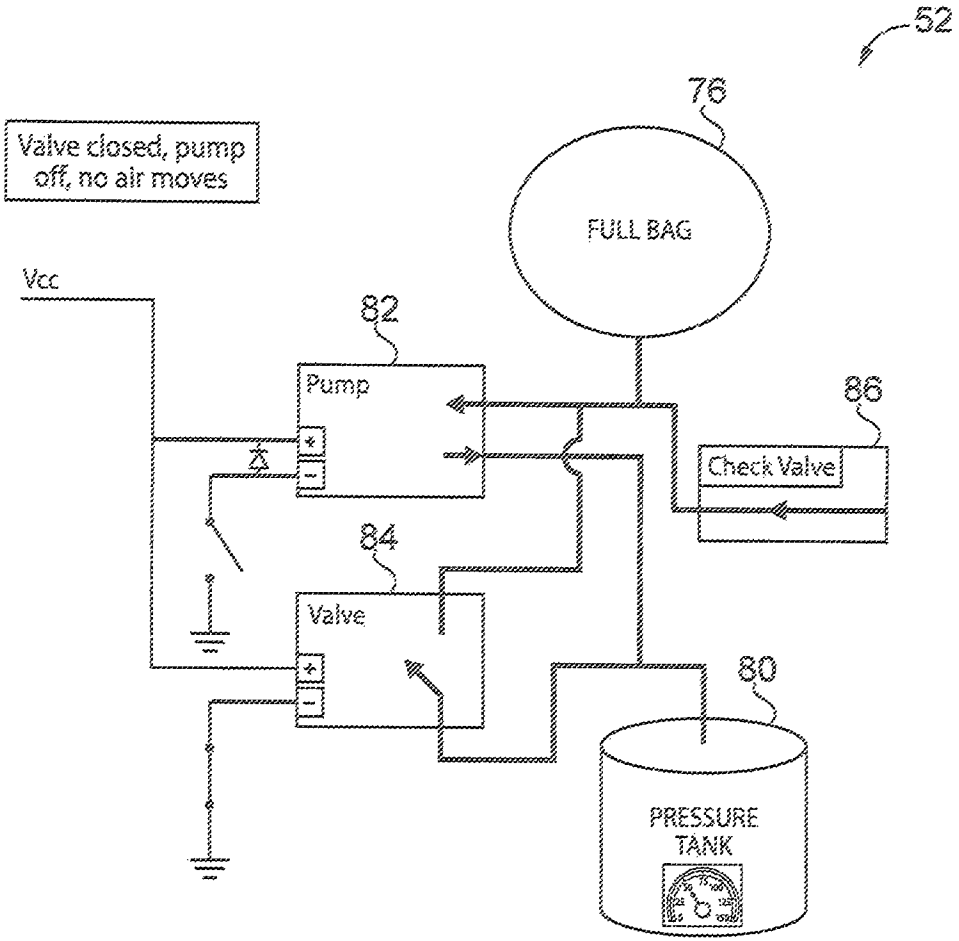
FIG. 3 depicts operation of an embodiment of the submersible drone.

FIG. 3 depicts a mode of operation in which power is applied to the valve 84, but removed from the pump 82. In this configuration none of the fluid in the ballast system (in this case air, but other gases can also be used) moves between the components. For example, without aid of the pump, no air is moved to the pressure vessel 80. Likewise, since the valve 84 is closed, no fluid is moved to the ballast bag 76.

Figure 4:
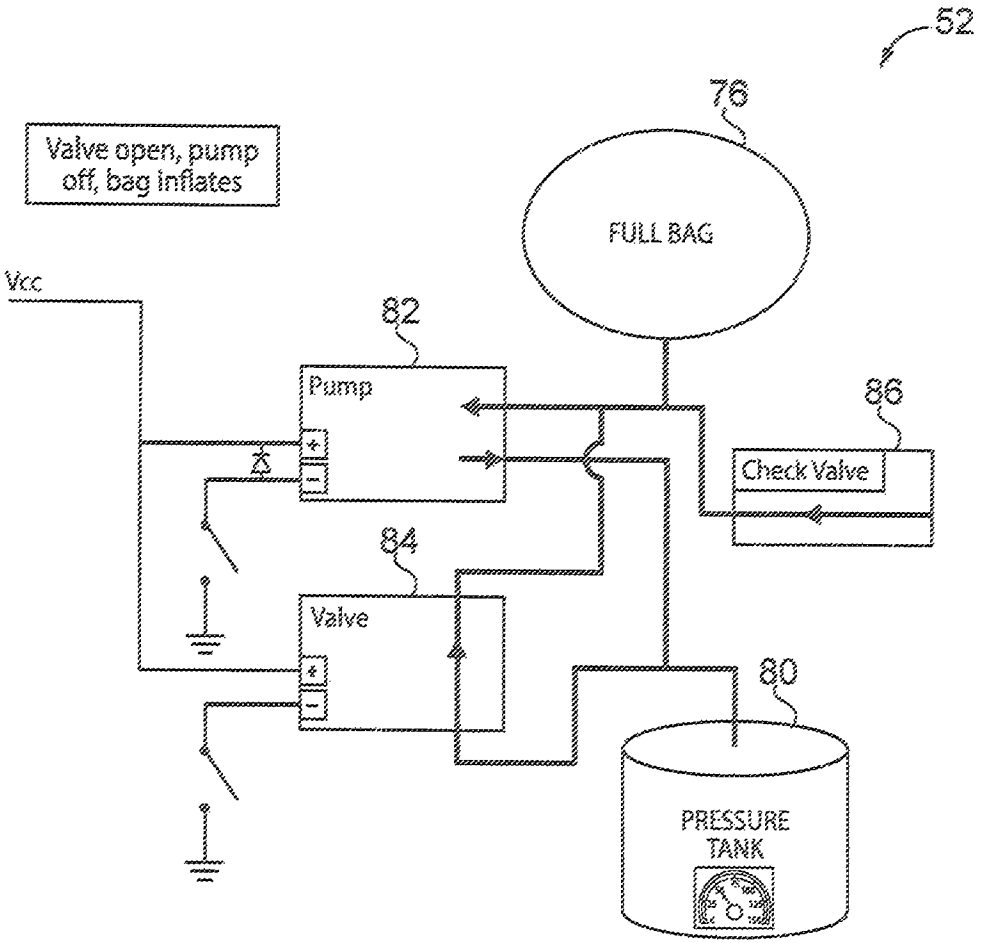
FIG. 4 depicts operation of an embodiment of the submersible drone.

FIG. 4 depicts a mode of operation in which power is off in both the pump 82 and the valve 84. In this configuration fluid is allowed to flow from the pressure vessel 80 to the ballast bag 76 until either pressure is balanced between the bag 76 and vessel 80, or until power is restored to the valve 84 to once again close off the valve. It can be noted in this embodiment that the valve 84 can act as a safety mechanism in case of total power failure in which the ballast bag 76 will become inflated which permits top side recovery of the ROV 52. Also of note in this embodiment, fluid from the pressure vessel 80 (e.g. air) will traverse a portion of conduit in a reverse direction as would be typically when the pump 82 is used to draw air from the ballast bag 76, as will be described immediately below.

Figure 5B:
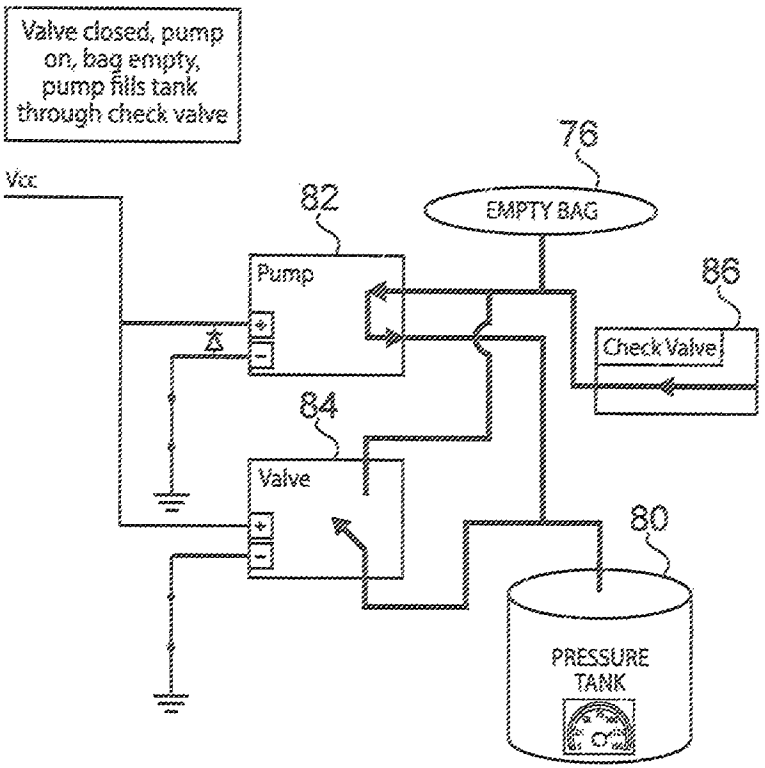
FIG. 5B depicts operation of an embodiment of the submersible drone.
Figure 5A:
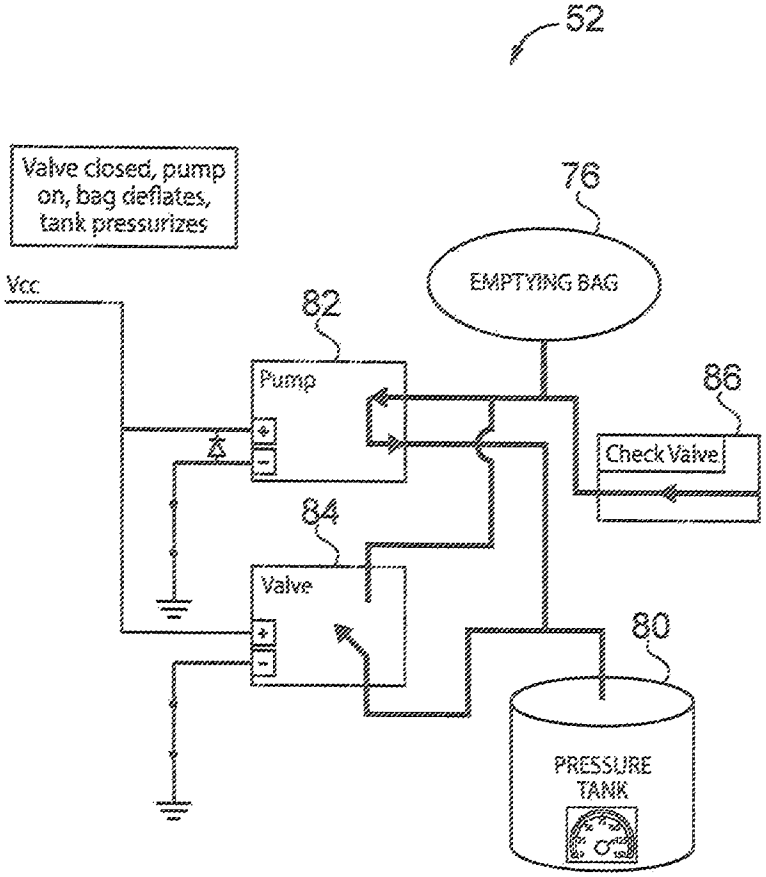
FIG. 5A depicts operation of an embodiment of the submersible drone.

FIGS. 5A and 5B depict a mode of operation in which power is applied to both the pump 82 and valve 84. In this configuration fluid (e.g. air) is allowed to flow from the pump 82 to the pressure vessel 80. In many embodiments the pressure vessel 80 is a rigid vessel. The embodiment depicted in FIG. 5A illustrates the draw down of air from the ballast bag 76, through the pump 82, and finally to the pressure vessel 80. The embodiment depicted in FIG. 5B illustrates the situation in which no further air can be delivered from the ballast bag 76 to the pump (e.g. by virtue of an empty bag or a bag that has reached a mechanical limit in its ability to flex any further to expel remaining air) in which case the check valve 86 will open and draw air once the pressure in the pump and bag system drop below the pressure beyond the check valve. The check valve 86 is in fluid communication with the open interior 78 mentioned above which allows air to be pulled in from the open interior 78 and delivered to the pressure vessel 80. In this way, any leakage of air from an interior of the ROV 52 can be addressed by drawing down the air pressure in the open interior 78 to mitigate the effects of air leakage into the transformer tank (or other type of closed vessel sensitive to the presence of a foreign fluid such as air). The air can be drawn down from the open interior 78 for a period of time suitable for the circumstance, at which time the ballast bag 76 can be re-inflated to resume operations or for purposes of recovery.

Figure 6:
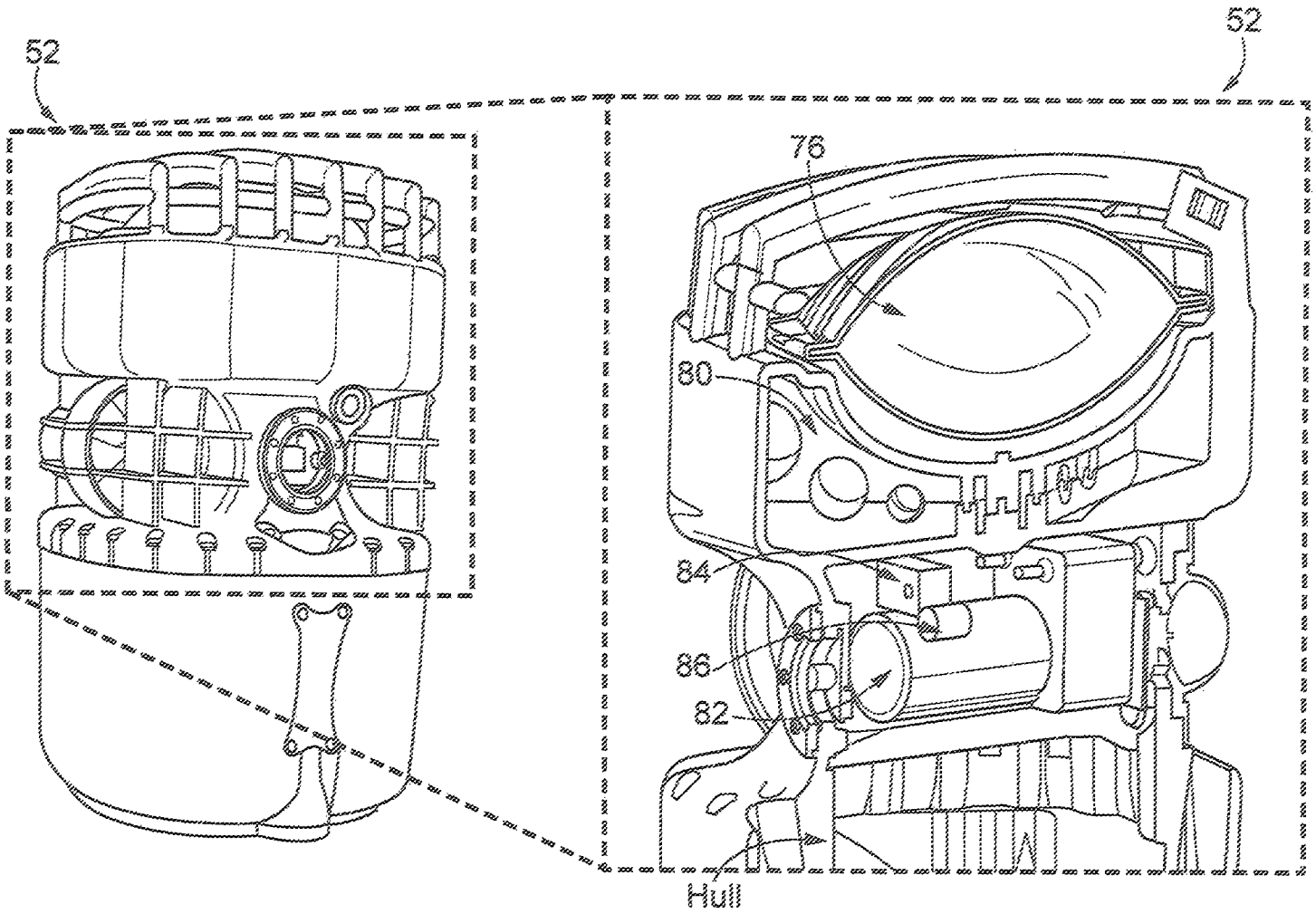
FIG. 6 depicts an embodiment of the submersible drone.

Turning now to FIG. 6, another embodiment of the ROV 52 is shown having the same components and operating in similar fashion to the embodiments depicted above in FIGS. 3-5B. Illustrated in FIG. 6 is the internal structure of the pressure vessel 80 which includes a number of internal baffling. The baffling can include any number of apertures, and any number of baffles can be used. The pressure vessel 80 is integral with the housing in FIG. 6. Use of the term "integral" includes separate parts that are integrated together to form the pressure vessel, as well as a construction that is monolithically formed as a single unit. Thus, the pressure vessel 80 can be formed by bringing two halves together (such as might be the case if the top half of the ROV 52 were formed as one piece which is later joined to a bottom half), or any of a number of constituent parts of the submersible (e.g. where the pressure vessel 80 is constructed as a separate component which is fastened into place with the ROV 52. For example, in some embodiments the pressure vessel is separately manufactured and installed in or on the submersible through any suitable attachment technique, such as mechanical fastening (bolt, rivet, etc), metallurgically (e.g. welding, etc), and chemically (e.g. bonding, etc). No limitation is hereby intended as to the type of attachment of the pressure vessel to the submersible.

The ballast bag 76 is also shown in FIG. 6 in which it is permitted to inflate and deflate as necessary to change displacement of the ROV 52, and thus its buoyancy. The ballast bag 76 can be enclosed within a lattice caged construction which consists of a series of elongate cross members that extend in generally the same direction, as seen in one embodiment in FIG. 6. The lattice cage, however, can have any number of configurations. For example, other embodiments can include a number of additional cross members oriented transverse to the elongate cross members illustrated, such that the lattice cage takes on a more traditional lattice structure. The lattice cage construction is used to protect the ballast bag 76 from foreign objects that may puncture the ballast bag 52.

The 'hull' depicted at the bottom of FIG. 6 can be the same as the open interior 78 described above. Thus, any variety of components can be installed within the hull which provide power and control circuitry to operate the ROV 52.

One mode of operation of the system 50 that can be used in whole or in part to various embodiments described above progresses as follows: to ensure reliable communication between the device 52 and the computer 54, a transceiver 68 can be inserted into the cooling oil tank through the service opening on the top of the transformer. In most embodiments, the transceiver 68 is used to exchange data information from a sensor on the ROV and the camera 70, via a controller to the computer 54; and motion control or maneuvering signals from the joystick 63 via the computer 54 to the controller so as to operate the motors 72 and thrusters. The signal 84, transmitted by the receiver 82 is used by the computer 54 to provide a separate confirmation to the device's position within the tank.

The computer 54 receives the position signals and information signals and in conjunction with a virtual image correlates the received signals to the virtual image so as to allow a technician to monitor and control movement of the inspection device. This allows the technician to inspect the internal components of the transformer and pay particular attention to certain areas within the transformer if needed. By utilizing a virtual image of the internal features of the transformer and the position of the inspection device with respect to those virtual features, the image obtained can be matched with the corresponding site inside the actual transformer tank. Based on the visual representation of the transformer image and a possible virtual inspection device in relation to the image, a technician can manipulate the joystick 63 response. The computer 54 receives the movement signals from the joystick and transmits those wirelessly to the antenna 74, whereupon the controller implements internally maintained subroutines to control the thrusters to generate the desired movement. This movement is monitored in realtime by the technician who can re-adjust the position of the device 52 as appropriate.

Figure 7:
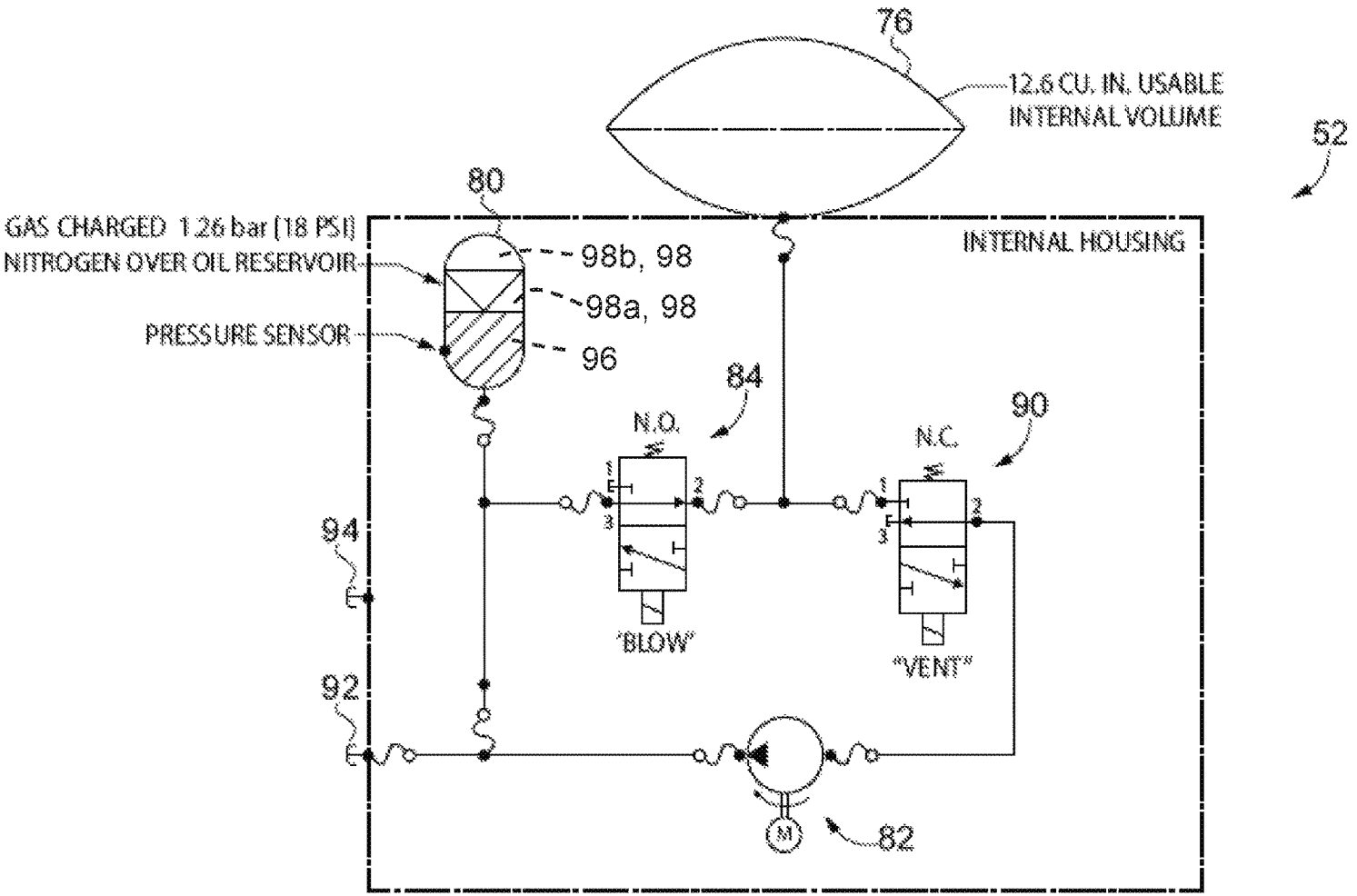
FIG. 7 depicts an embodiment of the submersible drone.

FIG. 7 depicts another embodiment of a ballast system useful with the ROV 52 discussed herein. The ballast system illustrated includes the pump 82 the pressure vessel 80, the inflatable bag 76, and the blow valve 84. The ballast system of FIG. 7 also includes a vent valve 90 and an alternative arrangement of conduits/passageways that connect the various components. The system illustrated in FIG. 7 also includes an external orifice 92 and external orifice 94 useful to convey fluids to/from the internal spaces of the ROV 52. Further details of the orifices 92 and 94 are described further below.

The pressure vessel 80 of FIG. 7 includes a compressible fluid 98 used to drive fluidic motion of an incompressible fluid 96 toward the inflatable bag 76 when the valve 84 is opened. The valve 84 can have a normally open state and that, when energized, can be placed in a closed condition to discourage flow of fluid therethrough. In some forms, the pressure vessel 80 can contain the compressible fluid 98 over top of some portion of the incompressible fluid 96. In some embodiments the compressible fluid 98 can be nitrogen, but any other suitable compressible fluid can also be used. The incompressible fluid 96 can be mineral oil, but other fluids are contemplated. In some forms the incompressible fluid 96 can be matched to the same fluid type in which the ROV 52 is operating. The valve 90 can be configured as a normally closed valve such that the valve 90 when energized can be placed in an open condition to permit fluid to flow therethrough.

When in operation the compressible fluid 98 in the pressure vessel 80 can expand and urge the incompressible fluid 96 toward the inflatable bag 76. Movement of the incompressible fluid 96 can be regulated by operation of the valve 84. The bag can be filled with incompressible fluid 96 at varying levels. In the illustrated embodiment, the inflatable bag 76 can include 12.6 inches of usable internal volume, but any suitable space can also be provided in other embodiments. When incompressible fluid 96 is desired to be removed from the inflatable bag 76, valve 84 can close and valve 90 opened. Pump 82 can be operated to withdraw incompressible fluid 96 from the inflatable bag 76 via the valve 90 and force the incompressible fluid 96 to return to the pressure vessel 80, at which point volumetric compression of the compressible gas 98 in the pressure vessel 80 occurs.

The ballast system illustrated in FIG. 7 can be a closed system with sufficient compressible fluid 98, e.g., a gas, and incompressible fluid 96 to provide negative, neutral, and/or positive buoyancy to the ROV 52. In some forms the ballast system includes a quantity of compressible fluid 98 and incompressible fluid 96 to provide all three of negative, neutral, and positive buoyancy, but some embodiments many include less than all range of buoyancies. In one form of operation, the ballast system can provide neutral buoyance for maneuvering the ROV 52 by forcing a quantity of incompressible fluid 96 away from the pressure vessel 80 to permit expansion of the compressible fluid 98. Such expansion lowers the density of the pressure vessel owing to lower mass of the compressible gas 98, thus raising the buoyancy of the ROV 52. Likewise, when incompressible fluid 96 is forced to return toward the pressure vessel 80, such compression of the compressible gas 98 raises the density of the pressure vessel owing to high mass concentration of the compressible gas 98, thus lowering buoyancy of the ROV 52. Depending on the quantity of incompressible fluid 96 used in the system, either complete or partial evacuation of incompressible fluid 96 from the pressure vessel 80 can occur.

The ballast system can thus provide a variety of operational capabilities in one or more embodiments. For example, the valve 84 can be opened to force a quantity of incompressible fluid 96 toward the inflatable bladder 76 which can be denoted as a neutral buoyancy quantity, after which the valve 84 can be closed. Such neutral buoyancy quantity can be used during operation of the ROV 52. Some embodiments may be designed such that sufficient pressure remains in the pressure vessel reservoir 80 to overcome hydrostatic pressures of the fluid in which the ROV 52 is operating and force additional incompressible fluid 96 to the inflatable bladder 76. If trouble occurs during operation in this embodiment the valve 84 can be opened to permit the additional quantity/pressure of the compressible fluid 98 remaining in the pressure vessel reservoir 80 to force additional incompressible fluid 96 toward the inflatable bladder 76 and thus lower the density of the pressure vessel reservoir 80, thus providing positive buoyancy. Such troubles may occur, for example, when power is lost to the valves 84 and 90. Such a situation will see the valves revert to their normal state such that valve 84 reverts to normally open and valve 90 reverts to normally closed. Such a situation can also be explicitly provided by an operator wherein the valves are commanded to be placed in their normal mode to provide for an open valve 84 and a closed valve 90.

Thus, in one form, the pressure vessel reservoir 80 includes a first amount 98*a* of compressible fluid 98 to provide neutral buoyancy to the remotely operated submersible 52 as well as a second, reserve amount 98*b* of compressible fluid 98 operable to expand the inflatable bladder 76 to provide positive buoyancy for purposes of a positive ascent. In some embodiments, the mass of the compressible fluid 98 in the ballast system includes the first amount 98*a* and the second, reserve amount 98*b* of the compressible fluid 98, which provides an emergency ascent change in buoyancy to the remotely operated submersible 52 when the valve 84 is in the open state. In some embodiments, the fluid of the ballast system includes a primary portion comprising the first amount 98*a* of the compressible fluid 98 and the incompressible fluid 96 for operation of the remotely operated submersible 52 and a backup portion comprising the second, reserve amount 98*b* for emergency ascent of the remotely operated submersible 52, and which includes blow valve 84 disposed fluidically between the pressure vessel reservoir 80 and the inflatable bladder 76, the blow valve 84 including a normally open state when the valve 84 is not energized to thereby permit the fluid to enter the inflatable bladder 76 through action of pressure in the pressure vessel reservoir 80.

The orifice 92 can be used to provide additional incompressible and/or compressible fluid to the ballast system. Orifice 94 can be used to communicate with an interior of the ROV 52. The pressure vessel 80 can include a pressure sensor in some embodiments useful to regulate movement of fluid/buoyancy state of the ROV 52.

As will be appreciated, the ROV 52 may be operated in different temperature environments and varying depths. The quantity of compressible fluid and incompressible fluid used in the ROV 52 can be sized to accommodate these large temperature and depth variations without need to onboard or offboard a quantity of either the compressible or incompressible fluid. Such variation may result in the inflatable bag 76 receiving more incompressible fluid in one operational environment than another at a given buoyancy condition. For example, assuming fixed quantities of compressible and incompressible fluid, in one operational environment the inflatable bag 76 may reach 60% of its volumetric capacity to receive incompressible fluid, while in another operational environment (e.g. different operating temperature) the inflatable bag 76 may reach nearly 100% of its volumetric capacity.

Figure 8B:
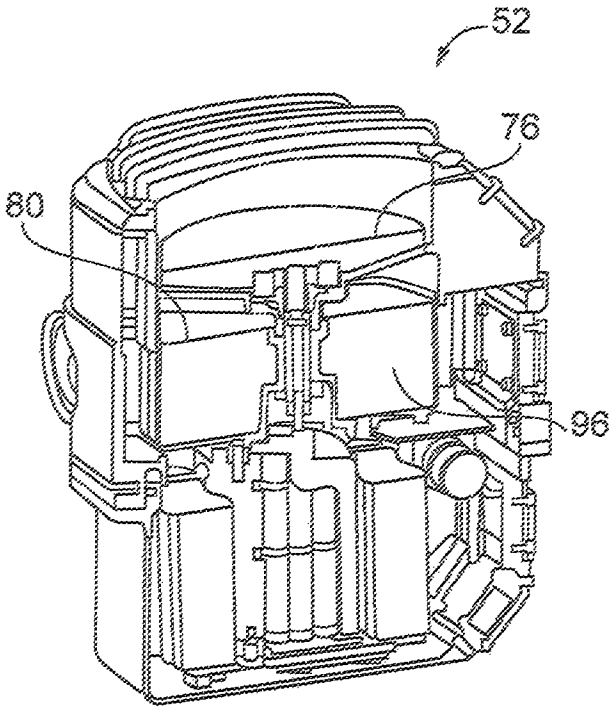
FIGS. 8A and 8B depict an embodiment of the submersible drone.
Figure 8A:
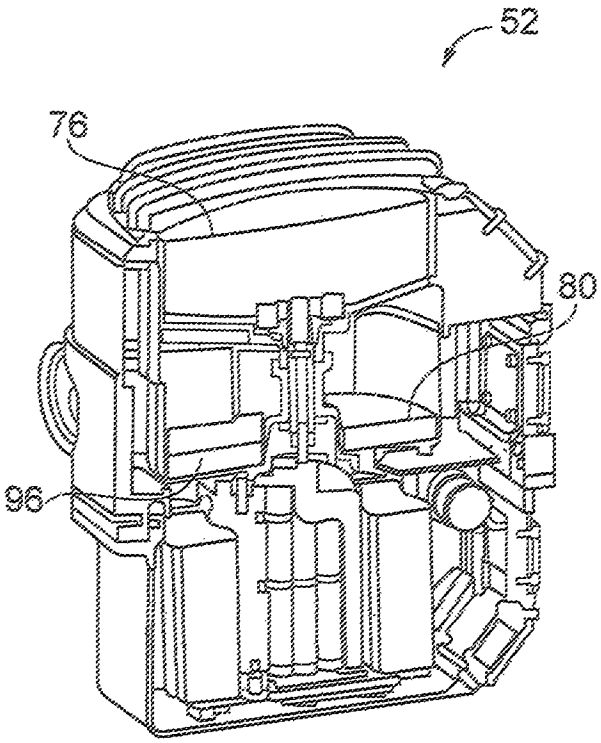

FIGS. 8A and 8B illustrate an embodiment of the ROV 52 which can use the ballast system illustrated in FIG. 7. Shown in FIG. 8 are analogous components as illustrated in FIG. 6, with the additional illustration of the incompressible fluid 96 being withdrawn from the inflatable bladder 76 back to the pressure vessel 80 from FIG. 8A to FIG. 8B.

One aspect of the present application includes an apparatus comprising a remotely operated submersible including an enclosed hull and having: an active ballast system having a pump, a pressure vessel reservoir, and an inflatable bladder, the pressure vessel reservoir in fluid communication with the inflatable bladder, the active ballast system further including a check valve fluidically disposed between the pressure vessel reservoir and the inflatable bladder, the check valve structured to permit egress of air from the enclosed hull and into the pressure vessel reservoir by action of the pump when the inflatable bladder is empty.

One feature of the present application further includes a liquid thruster used to propel and orient the remotely operated submersible, a control circuit structured to receive a command transmitted to the signal receiver, the control circuit operable to control a fluid flow of the liquid thruster.

A feature of the present application includes wherein the enclosed hull is a reclosable hull capable of being opened and closed.

Another feature of the present application includes wherein the reclosable hull includes a cover member that can be removed to permit ingress of outside air into the enclosed hull, and that can be replaced to discourage ingress of air into the enclosed hull, and which further includes a signal receiver structured to receive a command through a liquid environment from a remote control station, and wherein the remotely operated submersible is configured to inflate the inflatable bladder when the signal receiver fails to receive the command.

Still another feature of the present application further includes a valve fluidically disposed between the pressure vessel reservoir and the pump, the valve configured to be closed and discourage flow of fluid a when power is applied, and configured to be open and allow fluid to flow when power is not applied.

Yet another feature of the present application includes wherein the pump is configured to activated in an ON state when power is applied, and wherein when power is ON both the valve and the pump air is moved from the inflatable bladder to the pressure vessel reservoir.

Still yet another feature of the present application includes wherein power is OFF in both the valve and the pump air is moved via differential pressure from the pressure vessel reservoir to the inflatable bladder.

Yet still another feature of the present application includes wherein the pressure vessel reservoir is integral with a housing of the remotely operated submersible.

A further feature of the present application includes wherein the pressure vessel reservoir includes a plurality of internal baffles.

Another aspect of the present application includes an apparatus comprising a robotic drone structured to be operated beneath the surface and within a body of liquid, the robotic drone including a liquid propulsor for providing motive force to the drone, a recirculating air ballast system that includes an inflatable bladder structured to display fluid and act as a ballast for the robotic drone, and a lattice cage covering within which is situated the inflatable bladder, the cage including a plurality of cross members structured to permit the inflow and outflow of fluid displaced by inflation and deflation of the inflatable bladder.

A feature of the present application includes wherein the cross members of the lattice cage covering having a plurality of openings through which fluid flows during inflation and deflation of the inflatable bladder, the openings having a cross sectional area larger than the cross sectional air occupied by the plurality of cross members, such that blockage defined by the cross sectional area of the plurality of cross members divided by the cross sectional area of the openings is less than 1.

Another feature of the present application further includes a plurality of secondary cross members arranged transverse to the plurality of cross members.

Still another feature of the present application includes wherein the openings are rectilinear in shape, and which further includes a radio transmitter attached to the robotic drone and structured to broadcast a radiofrequency signal while the robotic drone is submerged in a liquid, and which further includes a plurality of cameras structured to capture images from the robotic drone.

Yet another feature of the present application includes wherein the robotic drone includes a reclosable hull that includes a gaseous filled interior and is structured to be hermetically sealed when closed.

Still yet another feature of the present application includes wherein the reclosable hull includes a removable cover which, when removed, exposes an interior of the reclosable hull to an outside air.

Yet still another feature of the present application further includes a pump in fluid communication with the inflatable bladder and a check valve placed between and in fluid communication with both the pump and inflatable bladder.

A further feature of the present application includes wherein the check valve draws air from the gaseous filled interior when the pump can no longer pull air from the inflatable bladder.

Still another aspect of the present application provides a method comprising propelling a submersible robotic drone through a liquid medium, the submersible robotic drone having an having an air filled interior compartment as well as a flexible ballast bladder in fluid communication via a conduit with a pressure vessel reservoir, regulating a height of the submersible drone by inflating and deflating the flexible ballast bladder, operating a pump to remove air from the flexible ballast bladder and deliver the removed air to a pressure vessel reservoir, and while continuing to operate the pump and at a minimal amount of air in the flexible ballast bladder, opening a check valve via pressure action of the pump to draw air from the air filled interior compartment to reduce air pressure in the interior compartment.

A feature of the present application further includes opening the air filled interior compartment to an outside air source to service a component of the submersible robotic drone.

Another feature of the present application includes wherein the propelling includes moving the submersible robotic drone within a fluid of an electrical transformer tank, and which further includes transmitting a command signal from a base station to the submersible robotic drone to draw the air from the air filled interior compartment to the pressure vessel.

Still another feature of the present application further includes activating the pump to draw air from the air filled interior compartment.

Yet still another feature of the present application further includes removing a cover of the air filled interior compartment to expose the compartment to outside air, and wherein the air filled interior compartment is exposed to air drawn from the air filled compartment from action of the pump is correspondingly drawn from the outside air through an opening exposed by removal of the cover.

Still yet another feature of the present application includes wherein the submersible robotic drone further includes a check valve fluidically between the flexible ballast bladder and the pressure vessel reservoir.

A further feature of the present application includes wherein the flexible ballast bladder and pressure vessel reservoir are part of a recirculating air ballast system.

Additionally, a further feature of the present application includes wherein the fluid is an incompressible fluid, and which further includes flowing an incompressible fluid away from the pressure vessel reservoir and toward the inflatable bladder while bypassing the pump, and further includes flowing the incompressible fluid away from the inflatable bladder and toward the pressure vessel reservoir by action of the pump.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid to the pressure vessel reservoir from the inflatable bladder to achieve variable buoyancy, wherein movement of the fluid out of the pressure vessel reservoir alters a density of the pressure vessel reservoir to provide a buoyant force for the remotely operated submersible; wherein the fluid is transferred from the pressure vessel reservoir to the inflatable bladder by a pressure of the fluid in the pressure vessel reservoir; and wherein the fluid is transferred back from the inflatable bladder to the pressure vessel reservoir by pumping the fluid with the pump.

2. The system for in-situ inspection of claim 1, which further includes a valve disposed between the pressure vessel reservoir and the inflatable bladder, the valve having an open state that permits fluid to flow to the inflatable bladder from the pressure vessel reservoir when power is not applied to the valve.

3. The system for in-situ inspection of claim 2, wherein the fluid is an incompressible fluid, and wherein the pressure vessel reservoir also includes a compressible fluid, the compressible fluid expanding to provide a change in density of the pressure vessel reservoir when the incompressible fluid moves from the pressure vessel reservoir to the inflatable bladder.

4. The system for in-situ inspection of claim 1, wherein the fluid is a compressible fluid.

5. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid between the pressure vessel reservoir and the inflatable bladder to achieve variable buoyancy, wherein movement of the fluid out of the pressure vessel reservoir alters a density of the pressure vessel reservoir to provide a buoyant force for the remotely operated submersible, the system further comprising a valve disposed between the pressure vessel reservoir and the inflatable bladder, the valve having an open state that permits fluid to flow to the inflatable bladder from the pressure vessel reservoir when power is not applied to the valve, wherein the fluid is an incompressible fluid, and wherein the pressure vessel reservoir also includes a compressible fluid, the compressible fluid expanding to provide a change in density of the pressure vessel reservoir when the incompressible fluid moves from the pressure vessel reservoir to the inflatable bladder; and wherein a mass of the compressible fluid in the ballast system includes a first amount providing neutral buoyancy to the remotely operated submersible, the ballast system also including a second, reserve amount providing an emergency ascent change in buoyancy to the remotely operated submersible when the valve is in the open state.

6. The system for in-situ inspection of claim 5, wherein the valve is a blow valve, and wherein the ballast system further includes a vent valve withdrawing the incompressible fluid from the inflatable bladder via action of the pump.

7. The system for in-situ inspection of claim 6, wherein the vent valve is in a normally closed state when the valve is not energized.

8. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid between the pressure vessel reservoir and the inflatable bladder to achieve variable buoyancy, wherein movement of the fluid out of the pressure vessel reservoir alters a density of the pressure vessel reservoir to provide a buoyant force for the remotely operated submersible, the system further comprising: a valve disposed between the pressure vessel reservoir and the inflatable bladder, the valve having an open state that permits fluid to flow to the inflatable bladder from the pressure vessel reservoir when power is not applied to the valve; and a signal receiver operative to receive a command through a liquid environment from a remote control station, and wherein the remotely operated submersible is configured to inflate the inflatable bladder when the signal receiver fails to receive the command.

9. The system for in-situ inspection of claim 8, wherein the pressure vessel reservoir is integral with a housing of the remotely operated submersible.

10. A method comprising: operating a remotely operated submersible having a ballast system; flowing a fluid from a pressure vessel reservoir to an inflatable bladder to change buoyancy of the remotely operated submersible; powering a pump to withdraw the fluid from the inflatable bladder; and flowing the fluid from the pump to the pressure vessel reservoir as a result of the powering the pump to thereby change a buoyancy of the remotely operated submersible; wherein the step of flowing the fluid to the inflatable bladder comprises transferring the fluid via a pressure of the fluid in the pressure vessel reservoir.

11. The method of claim 10, wherein the fluid is an incompressible fluid, and which further includes flowing the from the pressure vessel reservoir and toward the inflatable bladder while bypassing the pump, and further includes flowing the incompressible fluid away from the inflatable bladder and toward the pressure vessel reservoir by action of the pump.

12. The method of claim 11, wherein the ballast system includes a compressible fluid in addition to the incompressible fluid, and which further includes expanding the compressible fluid in the pressure vessel reservoir to thereby change the density of the pressure vessel reservoir and therefore buoyancy of the remotely operated submersible.

13. A method comprising: operating a remotely operated submersible having a ballast system; flowing a fluid from a pressure vessel reservoir to an inflatable bladder to change buoyancy of the remotely operated submersible; powering a pump to withdraw the fluid from the inflatable bladder; and flowing the fluid from the pump to the pressure vessel reservoir as a result of the powering a pump to thereby change a buoyancy of the remotely operated submersible, wherein the fluid of the ballast system includes a primary portion for operation of the remotely operated submersible and a backup portion for emergency ascent of the remotely operated submersible, and which further includes a blow valve disposed fluidically between the pressure vessel reservoir and the inflatable bladder, the blow valve including a normally open state when the valve is not energized to thereby permit the fluid to enter the inflatable bladder through action of a pressure in the pressure vessel reservoir.

14. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid to the pressure vessel reservoir from the inflatable bladder to achieve variable buoyancy, the ballast system configured to accommodate transfer of fluid from, and by a pressure within, the pressure vessel reservoir to the inflatable bladder while bypassing the pump, wherein movement of the fluid out of the pressure vessel reservoir alters a density of the pressure vessel reservoir to provide a buoyant force for the remotely operated submersible, wherein the pressure vessel reservoir, pump, and inflatable bladder form an enclosed fluidic system isolated from the body of liquid within which the remotely operated submersible is operating within.

15. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid between the pressure vessel reservoir and the inflatable bladder to achieve variable buoyancy, wherein movement of the fluid out of the pressure vessel reservoir alters a density of the pressure vessel reservoir to provide a buoyant force for the remotely operated submersible, further comprising a lattice cage covering within which is situated the inflatable bladder, the cage including a plurality of cross members permitting the inflow and outflow of liquid from the body of fluid which is displaced by inflation and deflation of the inflatable bladder.

16. The system for in-situ inspection of claim 15, wherein the cross members of the lattice cage covering having a plurality of openings through which fluid flows during inflation and deflation of the inflatable bladder, the openings having a cross sectional area larger than the cross sectional area occupied by the plurality of cross members.

17. A system for in-situ inspection comprising: a remotely operated submersible having a ballast system which includes a pump, a pressure vessel reservoir, and an inflatable bladder, the pressure vessel reservoir in fluid communication via the pump with the inflatable bladder, the pump circulating a fluid between the pressure vessel reservoir and the inflatable bladder to achieve variable buoyancy, wherein movement of the fluid out of the pressure vessel reservoir alters a density of the pressure vessel reservoir to provide a buoyant force for the remotely operated submersible, the system further comprising a valve disposed between the pressure vessel reservoir and the inflatable bladder, the valve having an open state that permits fluid to flow to the inflatable bladder from the pressure vessel reservoir when power is not applied to the valve, wherein the fluid is an incompressible fluid, and wherein the pressure vessel reservoir also includes a compressible fluid, the compressible fluid expanding to provide a change in density of the pressure vessel reservoir when at least a portion of the incompressible fluid moves from the pressure vessel reservoir to the inflatable bladder; and wherein the pressure vessel reservoir includes a first amount of compressible fluid to provide neutral buoyancy to the remotely operated submersible as well as a second, reserve amount of compressible fluid operable to force at least a portion of incompressible fluid remaining in the pressure vessel reservoir toward the inflatable bladder to further lower the density of the pressure vessel reservoir and provide positive buoyancy for purposes of a positive ascent.

* * * * *